US005343563A

United States Patent [19]

Goucher et al.

[11] Patent Number: 5,343,563

[45] Date of Patent: Sep. 6, 1994

[54] OUTBOARD MOTOR STEERING ROD RECEIVING MITT

[76] Inventors: Robert J. Goucher, 15806 5th Pl. S., Seattle, Wash. 98148; Morris R. Walls, 6211 1st Ave. NW., Seattle, Wash. 98107

[21] Appl. No.: 139,766

[22] Filed: Oct. 22, 1993

[51] Int. Cl.[5] ..... A41D 13/08

[52] U.S. Cl. ..... 2/17

[58] Field of Search ..... 2/16, 17, 247, 158, 2/164, 161.1

[56] References Cited

U.S. PATENT DOCUMENTS

| | | | |
|---|---|---|---|
| 1,478,582 | 12/1923 | Schallman | 2/164 |
| 2,103,711 | 12/1937 | Cole | 2/160 |
| 3,638,011 | 1/1972 | Bain et al. | 2/160 X |
| 4,625,337 | 12/1986 | Zahn | 2/247 X |
| 4,862,521 | 9/1989 | Mann | 2/160 |

FOREIGN PATENT DOCUMENTS

| | | | |
|---|---|---|---|
| 2540709 | 8/1984 | France | 2/16 |
| 2604868 | 4/1988 | France | 2/159 |

*Primary Examiner*—Clifford D. Crowder
*Assistant Examiner*—Sara M. Current
*Attorney, Agent, or Firm*—E. Michael Combs

[57] ABSTRACT

A flexible L-shaped mitt member includes a first end to resiliently engage and secure an outboard motor steering rod therethrough directing the rod into the mitt cavity, with the mitt having a second end opening arranged to receive an individual's arm therethrough to grasp the rod within the mitt at a junction of the mitt first and second legs.

2 Claims, 4 Drawing Sheets

OUTBOARD MOTOR STEERING ROD RECEIVING MITT

BACKGROUND OF THE INVENTION

1. Field of the Invention

The field of invention relates to hand enclosure structure, and more particularly pertains to a new and improved outboard motor steering rod receiving mitt arranged to receive and grasp a steering rod of an associated outboard motor therewithin.

2. Description of the Prior Art

The use of various hand enclosures such as indicated in U.S. Pat. No. 3,746,356 relative to ski poles and the like is typical of the prior art providing for hand shielding, wherein the instant invention is arranged to provide for a mitt arranged to receive a steering rod relative to an outboard motor to secure the steering rod within the mitt providing protection relative to inclement weather. To this end, the instant invention substantially fulfills this need.

SUMMARY OF THE INVENTION

In view of the foregoing disadvantages inherent in the known types of mitt construction now present in the prior art, the present invention provides an outboard motor steering rod receiving mitt wherein the same is arranged to permit grasping of an outboard motor steering rod within the mitt construction. As such, the general purpose of the present invention, which will be described subsequently in greater detail, is to provide a new and improved outboard motor steering rod receiving mitt which has all the advantages of the prior art hand protective devices and none of the disadvantages.

To attain this, the present invention provides a flexible L-shaped mitt member including a first end to resiliently engage and secure an outboard motor steering rod therethrough directing the rod into the mitt cavity, with the mitt having a second end opening arranged to receive an individual's arm therethrough to grasp the rod within the mitt at a junction of the mitt first and second legs.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved outboard motor steering rod receiving mitt which has all the advantages of the prior art hand protective devices and none of the disadvantages.

It is another object of the present invention provide a new and improved outboard motor steering rod receiving mitt which may be easily and efficiently manufactured marketed.

It is a further object of the present invention to provide a new and improved outboard motor steering rod receiving mitt which is of a durable and reliable construction.

An even further object of the present invention is to provide a new and improved outboard motor steering rod receiving mitt which is susceptible of a low cost of manufacture with regard to both materials and labor, and which accordingly is then susceptible of low prices of sale to the consuming public, thereby making such outboard motor steering rod receiving mitts economically available to the buying public.

Still yet another object of the present invention is to provide a new and improved outboard motor steering rod receiving mitt which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
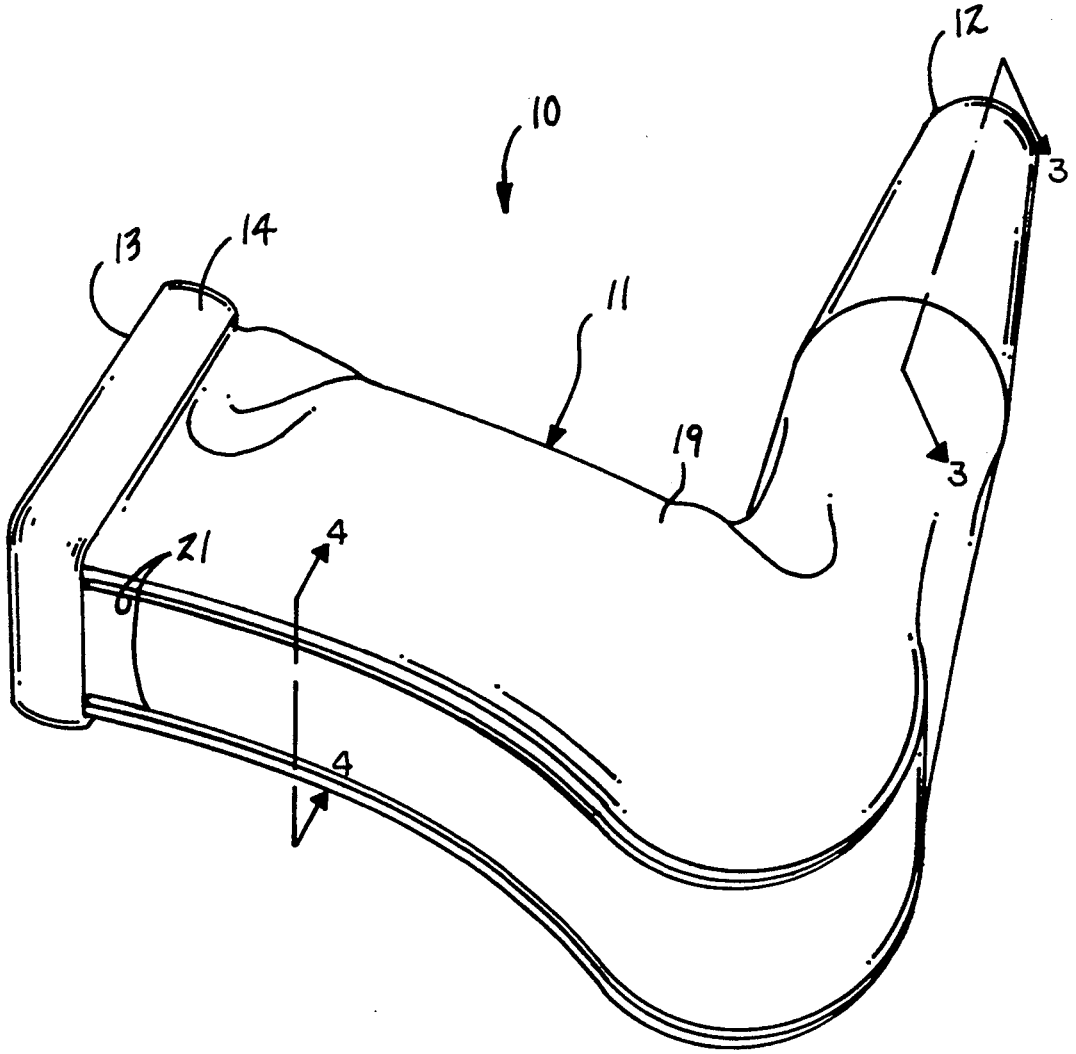
FIG. 1 is an isometric illustration of the invention.

With reference now to the drawings, and in particular to FIGS. 1 to 6 thereof, a new and improved outboard motor steering rod receiving mitt embodying the principles and concepts of the present invention and generally designated by the reference numerals 10 and 10*a* will be described.

Figure 2:
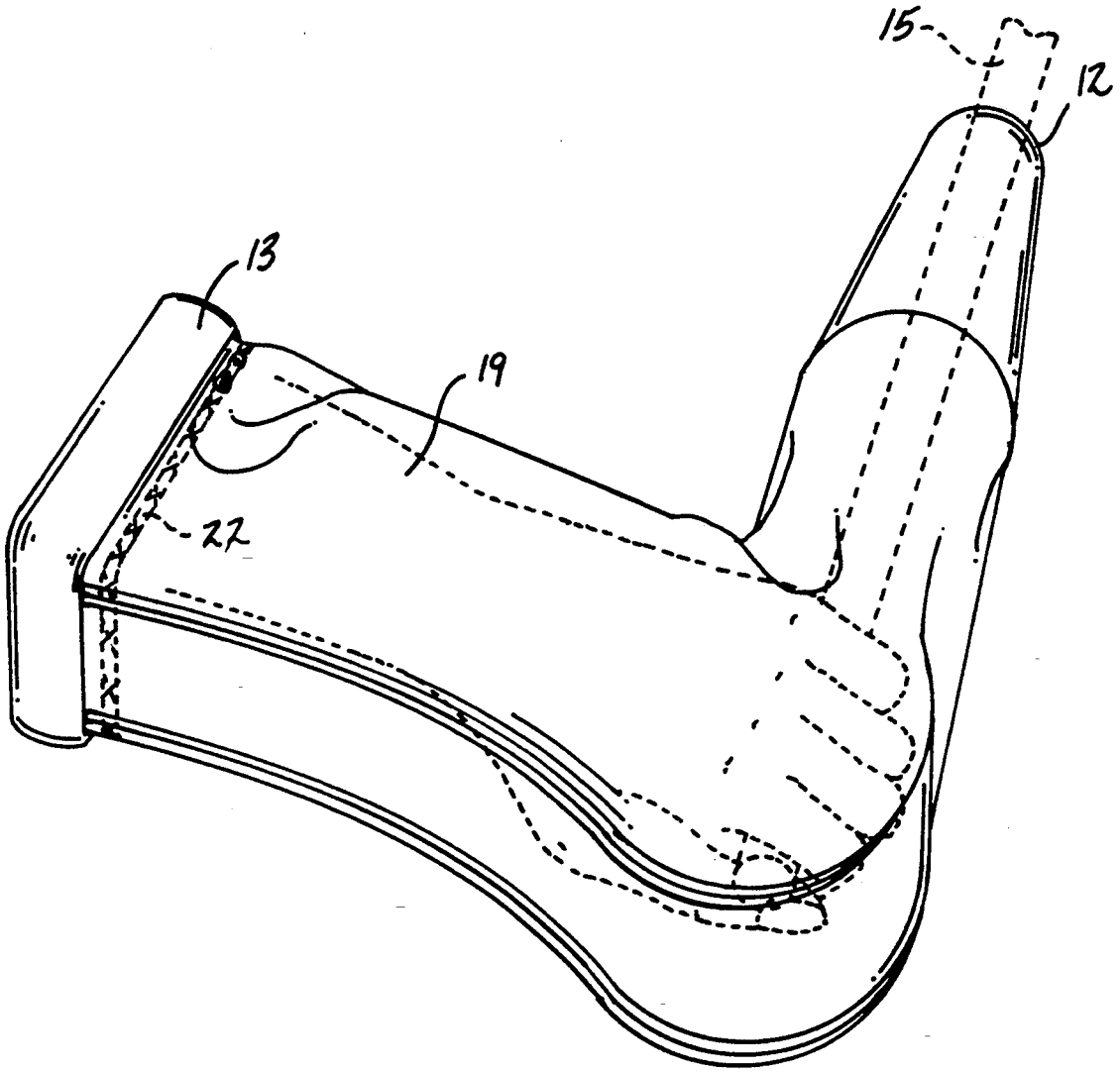
FIG. 2 is an isometric illustration of the invention arranged in use permitting an individual's hand to secure a steering rod from an associated outboard motor.
Figure 3:
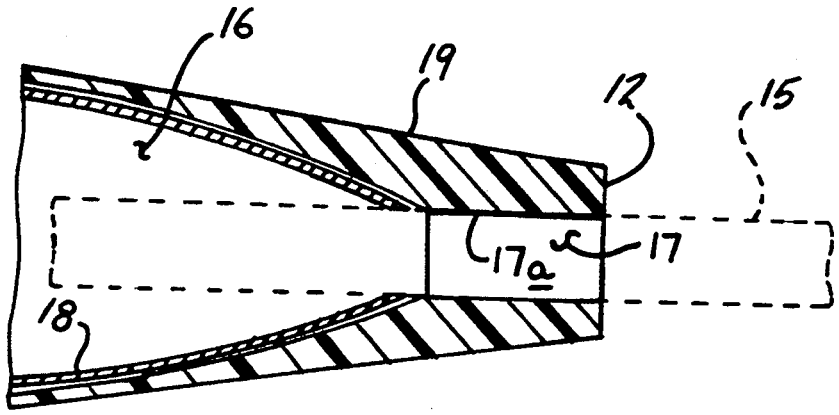
FIG. 3 is an orthographic view, taken along the lines 3—3 of FIG. 1 in the direction indicated by the arrows.
Figure 4:
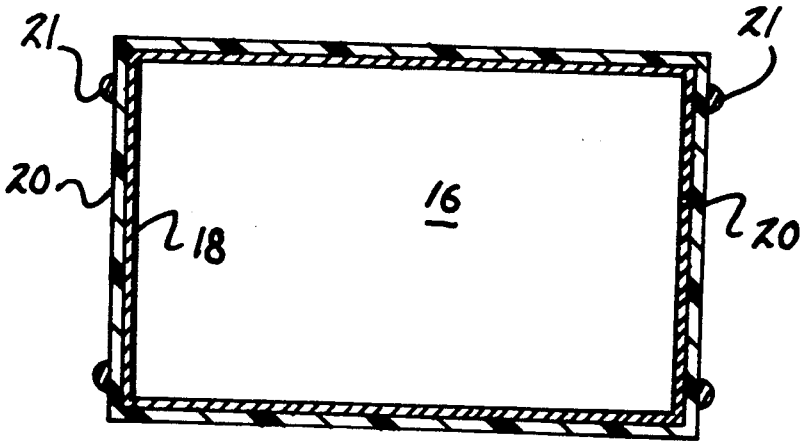
FIG. 4 is an orthographic view, taken along the lines 4—4 of FIG. 1 in the direction indicated by the arrows.
Figure 5:
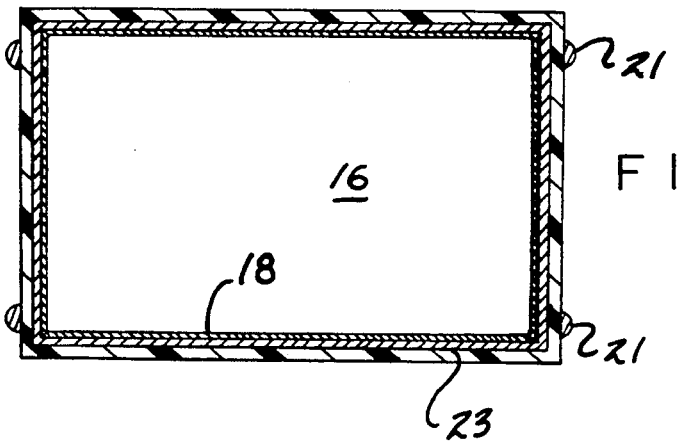
FIG. 5 is an isometric illustration of a modified cross-sectional construction, as indicated in FIG. 6, taken along the lines 5—5 thereof in the direction indicated by the arrows.

More specifically, the outboard motor steering rod receiving mitt 10 of the instant invention essentially comprises an L-shaped body 11, as indicated in FIG. 1, having a rod receiving first end 12 and an entrance second end 13. The entrance second end 13 includes a surrounding flexible cuff 14 formed of a shape retentent material arranged to receive an individual's arm therethrough, in a manner as indicated in FIG. 2, to permit grasping of a steering rod 15 directed through the rod receiving first end 12, wherein the steering rod 15 (see FIG. 3) is resiliently engaged by the first end opening 17 having a surrounding resilient wall 17*a*. Directed throughout the L-shaped body 11 is a body cavity 16, also of an L-shaped configuration, wherein a removable lining 18 is provided such that the lining is formed of a fluid absorbent material in contrast to the polymeric fluid impermeable outer shell 19 of the body 11, wherein the shell 19 is also formed of an L-shaped configuration having body side wails 20, with the body side walls 20 including coextending piping rods 21 formed of resilient shape retentive material to maintain the L-shaped configuration of the L-shaped body 11.

Figure 6:
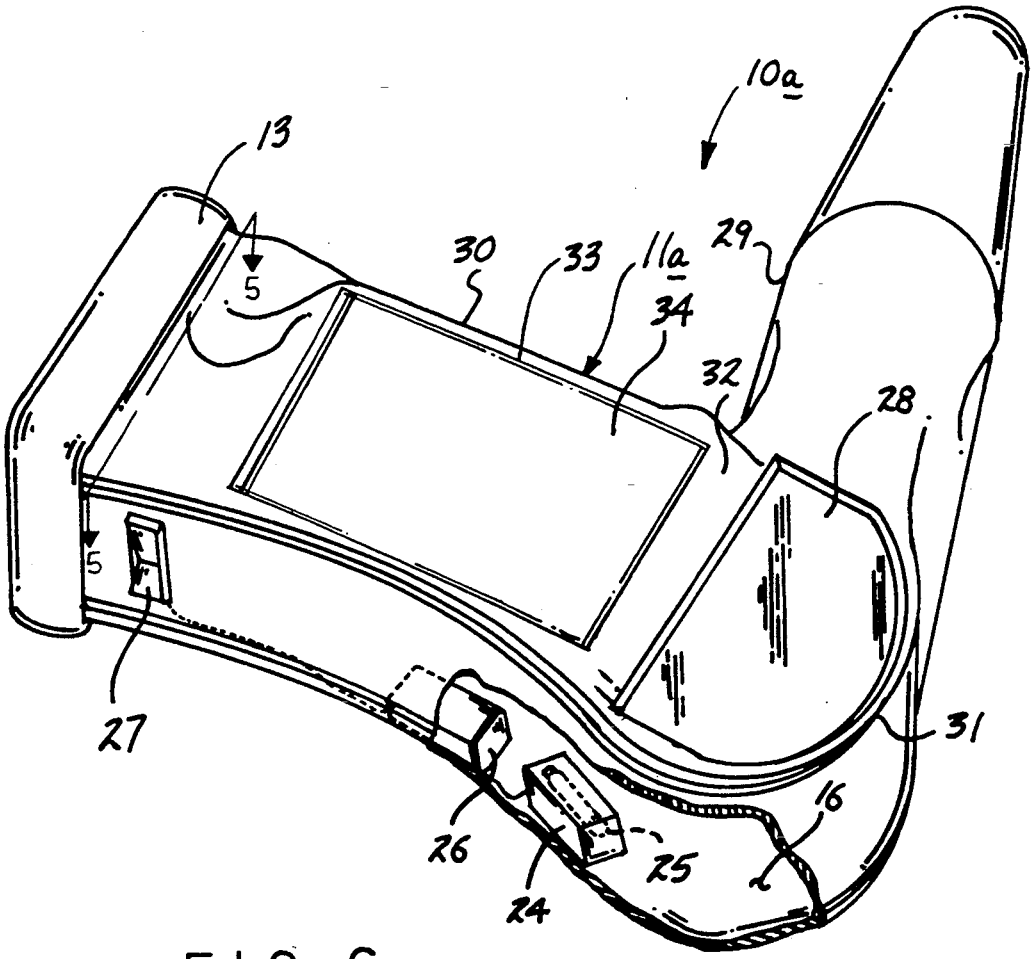
FIG. 6 is an isometric illustration of a modified aspect of the invention.

As indicated in FIG. 6, a modified mitt construction 10*a* includes a modified body structure 11*a*, such that a zipper 22 permits the removal of the lining 18, wherein a medial cloth lining 23 is oriented between the removable lining 18 and the outer shell 19. The removable lining is also indicated for removal by the zipper construction, as illustrated in FIG. 2, relative to the mitt construction 10.

Within the cavity 16 of the modified construction 10*a* is positioned an illumination housing 214 containing illumination bulb 25 in electrical communication with a battery 26 operative through a switch member 27 projecting through the body side wall 20. The body 11*a* includes first and second housing legs 29 and 30 intersecting at a housing junction 31, such that the housing includes a housing top wall 32, such that a transparent lens 28 is directed through the L-shaped body 11 permitting visual observation within the cavity 16 through the transparent lens 28. Further, mounted upon the housing top wall 32 on the second leg 30 is a pocket 33 having a transparent pocket top web 34. In this manner, positioned within the pocket are various items such as a fishing license, boat license, and the like in a convenient manner relative to the outboard motor available for inspection, as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the paris of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention, Further, since numerous modifications and changes will readily occur to those skilled the art, it is not desired to limit the invention to the exact construction and operation shown and described, and accordingly, all suitable modifications and equivalents may be resorted to, falling within the scope of the invention,

What is claimed as being new and desired to be protected by LETTERS PATENT of the United States is as follows:

1. An outboard motor steering rod receiving mitt, comprising, an L-shaped body, the L-shaped body having a first housing leg and a second housing leg, with an L-shaped cavity extending throughout the L-shaped body within the first housing leg and the second housing leg, the first housing leg having a rod receiving first end, with the second housing leg having an entrance second end, with the entrance second end and the rod receiving first end in communication with the body cavity, and the rod receiving first end having a first end opening to include a resilient interior wall arranged to engage an outboard motor steering rod, the second end includes a surrounding flexible cup in adjacency relative to the second end formed of a shape retentive material, the L-shaped body includes an outer polymeric fluid impermeable shell and an inner removable lining removably mounted relative to the shell, wherein the inner lining is arranged coextensively throughout the body cavity, the first housing leg and the second housing leg intersect one another at a housing junction, with the L-shaped body having a body top wall and body side walls, and the body top wall including a transparent lens directed therethrough permitting visual views within the body cavity, including an illumination housing mounted within the body cavity in adjacency to the housing junction, with the illumination housing including an illumination bulb arranged to permit illumination in the junction, and a battery mounted within the body cavity in adjacency to the illumination housing, and a switch member directed through one of said body side walls arranged to effect selective illumination of the illumination bulb within the illumination housing.

2. A mitt as set forth in claim 1 including a pocket mounted onto the body top wall of the second housing leg, with the pocket including a transparent pocket top web arranged for visual observation within the pocket.

* * * * *